US006197486B1

(12) United States Patent
Majumdar et al.

(10) Patent No.: US 6,197,486 B1
(45) Date of Patent: Mar. 6, 2001

(54) REFLECTIVE PRINT MATERIAL WITH EXTRUDED ANTISTATIC LAYER

(75) Inventors: Debasis Majumdar; Jehuda Greener, both of Rochester; Thomas M. Laney, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/472,485

(22) Filed: Dec. 27, 1999

(51) Int. Cl.[7] ..... G03C 1/89; G03C 1/79

(52) U.S. Cl. ..... 430/527; 430/529; 430/531; 430/536

(58) Field of Search ..... 430/527, 529, 430/531

(56) References Cited

U.S. PATENT DOCUMENTS

| | | | |
|---|---|---|---|
| 3,671,248 | 6/1972 | Eldridge et al. . | |
| 4,547,445 | 10/1985 | Asahina et al. | 430/523 |
| 4,571,361 | 2/1986 | Kawaguchi et al. | 430/527 |
| 5,045,394 | 9/1991 | Saverin et al. | 430/527 |
| 5,110,639 | 5/1992 | Akao | 428/35.2 |
| 5,156,707 | 10/1992 | Kato et al. | 162/137 |
| 5,159,053 * | 10/1992 | Kolycheck et al. | 528/76 |
| 5,221,555 | 6/1993 | Saverin et al. | 427/209 |
| 5,232,824 | 8/1993 | Saverin et al. | 430/527 |
| 5,244,728 | 9/1993 | Bowman et al. | 430/527 |
| 5,318,886 | 6/1994 | Saverin et al. | 430/536 |
| 5,360,707 | 11/1994 | Kato et al. | 430/538 |
| 5,405,907 | 4/1995 | Bowman et al. | 430/529 |
| 5,466,536 | 11/1995 | Berner et al. | 430/527 |
| 5,652,326 * | 7/1997 | Ueda et al. | 528/288 |
| 5,863,466 * | 1/1999 | Mor | 252/500 |

OTHER PUBLICATIONS

Derwent WPI Acc. No. 96–204406; (Abstract JP 8072213, Mar. 19, 1996).

D. Djordjevic, "Coextrusion", Rapra Review Reports, 1992, vol. 6, No. 2, pp. 3–15.

W. J. Schrenk & T. Alfrey, Jr., "Coextruded Multilayer Polymer Films and Sheets", Chap. 15, 1978, pp. 129–165.

* cited by examiner

*Primary Examiner*—Richard L. Schilling
(74) *Attorney, Agent, or Firm*—Paul A. Leipold

(57) ABSTRACT

The invention relates to a reflection photographic imaging material comprising at least one silver halide layer and a base material comprising at least one extruded layer comprising a polymeric antistatic material.

13 Claims, No Drawings

REFLECTIVE PRINT MATERIAL WITH EXTRUDED ANTISTATIC LAYER

FIELD OF THE INVENTION

This invention relates in general to imaging elements, such as photographic, electrostatographic and thermal imaging elements, and in particular to imaging elements comprising a support, an image-forming layer, and an electrically-conductive layer used in reflective photographic media. More specifically, this invention relates to electrically-conductive layers comprising electrically-conductive polymers which can be applied during film extrusion and are integral to the reflective photographic support, and to the use of such electrically-conductive layers in imaging elements for such purposes as providing protection against the generation of static electrical charges.

BACKGROUND OF THE INVENTION

The problem of controlling static charge is well known in the field of photography. The accumulation of charge on film or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines, and during finishing operations such as slitting and spooling.

It is generally known that electrostatic charge can be dissipated effectively by incorporating one or more electrically-conductive "antistatic" layers into the support structure. Antistatic layers can be applied to one or to both sides of the support as subbing layers either beneath or on the side opposite to the light-sensitive silver halide emulsion layers. An antistatic layer can alternatively be applied as an external layer either over the emulsion layers or on the side of the support opposite to the emulsion layers or both. For some applications, the antistatic agent can be incorporated into the emulsion layers. Alternatively, the antistatic agent can be directly incorporated into the support itself.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness, and poor adhesion to the antistatic layer.

Besides antistatic properties, an auxiliary layer in a photographic element may be required to fulfill additional criteria depending on the application. For example, for resin-coated photographic paper, the antistatic layer if present as an external backing layer should be able to receive prints (e.g., bar codes or other indicia containing useful information) typically administered by dot matrix printers and to retain these prints or markings as the paper undergoes processing. Most colloidal silica based antistatic backings without a polymeric binder provide poor post-processing backmark retention qualities for photographic paper.

In general, poor adhesion of the antistatic coating onto the resin-coated paper support may be responsible for a number of problems during manufacturing, sensitizing, and photofinishing. Poor adhesion or cohesion of the antistatic layer can lead to unacceptable dusting and track-off. A discontinuous antistatic layer, resulting from dusting, flaking, or other causes, may exhibit poor conductivity and may not provide necessary static protection. It can also allow leaching of calcium stearate from the paper support into the processing tanks causing buildup of stearate sludge. Flakes of the antistatic backing in the processing solution can form soft tar-like species which, even in extremely small amounts, can redeposit as smudges on drier rollers eventually transferring to image areas of the photographic paper, creating unacceptable defects.

Although the prior art is replete with patents disclosing various antistatic backings for photographic paper (for example, U.S. Pat. Nos. 3,671,248; 4,547,445; 5,045,394; 5,156,707; 5,221,555; 5,232,824; 5,244,728; 5,318,886; 5,360,707; 5,405,907 and 5,466,536), not all of the aforesaid issues are fully addressed by these inventions. A vast majority of the prior art involves coatings of antistatic layers from aqueous or organic solvent based coating compositions. This technique, however, necessitates an effective elimination of the solvent which may not be trivial especially under faster drying conditions, as dictated by efficiency. An improper drying will invariably cause coating defects, generating waste or inferior performance.

PROBLEM TO BE SOLVED BY THE INVENTION

There is a need for antistatic layers that are an integral part the photographic support and do not require an additional step for antistatic coating after the support formation.

SUMMARY OF THE INVENTION

It is an object of the invention to provide improved antistatic protection to a reflection photographic imaging element.

It is another object of the invention to apply an antistatic layer is a less costly manufacturing process.

It is a further object of the invention to have an antistatic layer that is transparent or translucent and is able to survive photographic processing.

These and other objects of the invention are accomplished by reflection photographic imaging element comprising at least one silver halide layer, a support comprising at least one extruded layer comprising an antistatic material. Said antistaic layer is formed integrally with the polymeric sheet by the (co)-extrusion method during the support manufacturing step.

ADVANTAGEOUS EFFECT OF THE INVENTION

The invention provides a photographic support with an integral antistatic layer that does not require an additional antistatic coating step after base formation.

DETAILED DESCRIPTION OF THE INVENTION

The invention has numerous advantages over prior practices in the art. The invention provides photographic materials that have good antistatic properties and do not require a separate step for antistatic coating. Further, the imaging members of the invention are much less likely to lose antistatic materials during processing and handling of the imaging layers. The imaging members of the invention having integral antistatic layers do not require a separate step for coating antistatic materials which would require removal of solvents and thereby increase manufacturing costs. As the imaging material of the invention is not aftercoated with the antistatic material, there is no need for the drying step required in the prior art processes. There is a cost advantage, as there is one less coating and drying step required in image member formation. These and other advantages will be apparent from the detailed description below.

There are several materials known in the art that can be melt-processed while retaining their antistatic property and overall physical performance. These materials include various polymeric substances containing a high concentration of polyether blocks. Ionic conduction along the polyether chains makes these polymers inherently dissipative, yielding surface resistivities in the range $10^{8-1013}$ ohm/square. Examples of such ionic conductors are: Polyether-block-copolyamide such as disclosed in U.S. Pat. Nos. 4,361,680; 4,332,920; and 4,331,786. Polyetheresteramide (e.g., as disclosed in U.S. Pat. Nos. 5,604,284; 5,652,326; and 5,886,098) and a thermoplastic polyurethane containing a polyalkylene glycol moiety (e.g., as disclosed in U.S. Pat. Nos. 5,159,053 and 5,863,466). Such inherently dissipative polymers (IDPs) have been shown to be fairly thermally stable and readily processable in the melt state in their neat form or in blends with other thermoplastic materials. Alternatively, the electronically conducting polymers such as substituted or unsubstituted polyanilines (e.g., as disclosed in U.S. Pat. Nos. 5,232,631; 5,246,627; and 5,624,605) suitable for melt processing can also be used for this invention, provided the amount and thickness of these layers do not impart undesirable color to the support. For the sake of simplicity, these electronically conducting polymers will also be referred to as IDPs henceforth. It is observed that the aforementioned polymeric conductors, when incorporated as per the present invention, can provide antistatic protection at a wide range of relative humidity (RH), as illustrated in the examples below.

In this invention, the use of various IDPs containing polyalkylene glycol chains as antistatic layers is preferred since, due to their excellent melt processability, these layers can be formed directly during the (co)-extrusion step of the film forming process, thus eliminating the need to coat and dry a solvent-based antistatic layer as has been the practice heretofore. By contrast, co-extrusion of inorganic conductive filler dispersed in a polymeric matrix to form an extrudable conductive layer is impractical since the melt viscosity of such a dispersion is likely to be considerably higher than that of the base polymer at the high volume fractions (typically >30–60%) needed to achieve high conductivity. Generally, co-extrusion of adjacent layers with highly varying melt viscosities is not feasible particularly at high production throughputs.

The various IDPs can be co-extruded neat or as alloys. The concentration of the IDP in the antistatic layer must exceed some critical concentration to insure that the electrical resistance of the layer is maintained at a desired level of less than 13 log ohms/square. If used as an alloy, the antistatic layer may contain a small amount of a compatibilizer or a dispersing aid to improve the uniformity and quality of the dispersion of the electrically conductive polymer in the matrix. The polymers suitable for alloying can be chosen from a group of melt processable polymers such as polyolefins, polyesters, acrylics, styrenics, polyurethanes, polycarbonates, polyimides, and combinations thereof. For application in reflective photographic imaging elements, the preferred alloying polymers include polyolefins, polyesters, and polyurethanes, the most preferred being polyolefins. The suitable alloying polyolefins for the present invention include polyethylene, polypropylene, polymethylpentene, polybutylene, and mixtures thereof. Polyolefin co-polymers including co-polymers of propylene and ethylene such as hexene, butene, and octene are also useful. Generally, alloying the IDP with another polymer should help in lowering cost, improving adhesion, processability, and mechanical properties of the antistatic layer.

When co-extruded, the antistatic layer can be formed on a polymeric carrier layer chosen from a group of melt processable polymers such as polyolefins, polyesters, acrylics, styrenics, polyurethanes, polycarbonates, polyimides, and combinations thereof. For application in reflective photographic imaging elements, the preferred polymeric base layer can include polyolefins, polyesters, and polyurethanes, the most preferred being polyolefins. The suitable polyolefins as base layer for the present invention include polyethylene, polypropylene, polymethylpentene, polybutylene, and mixtures thereof. Polyolefin co-polymers, including co-polymers of propylene and ethylene such as hexene, butene, and octene are also useful. Any one of the known techniques for co-extruding cast polymer sheets can be employed to form the integral multilayered polymeric sheet of the invention. Typical co-extrusion technology is taught in W. J. Schrenk and T. Alfrey, Jr., "Coextruded Multilayer Polymer Films and Sheets," Chapter 15, Polymer Blends, p. 129–165, 1978, Academic Press; and D. Djorjevic, "Coextrusion," Vol. 6, No. 2, 1992, Rapra Review Reports.

In addition to the antistatic layer(s) and the carrier layer, the polymeric sheet of this invention may comprise any number of additional layers to achieve different objectives, such as adhesion promotion, abrasion resistance, antihalation, curl control, moisture barrier, conveyance, print retention, etc.

Any of the layers of the polymeric sheet of the current invention may contain, in suitable combination, various inorganic and organic additives, for instance, white pigments such as titanium oxide, zinc oxide, talc, calcium carbonate, etc., matte beads, plasticizers, compatibilizers, dispersants, for example, fatty amides such as stearamide, etc., hardeners, quaternary salts, metallic salts of fatty acids such as zinc stearate, magnesium stearate, etc., pigments and dyes, such as ultramarine blue, cobalt violet, etc., antioxidant, fluorescent whiteners, ultraviolet absorbers.

In one embodiment of this invention, such a polymeric sheet comprising the aforesaid antistatic layer may be directly extruded on a reflective photographic base, such as paper or synthetic paper, with or without any surface modification, in a typical resin-coating operation. In another embodiment of this invention, such a polymeric film, after it is cast on a chilled roll, is preferably oriented by stretching, and subsequently laminated on a reflective photographic base, such as paper or synthetic paper, with or without any surface modification. The latter application of the present invention is particularly suitable for photographic paper comprising biaxially oriented microvoided polyolefine layer (s), as disclosed in U.S. Pat. Nos. 5,853,965; 5,866,282; and 5,874,205. Methods of uniaxially or biaxially orienting sheet or film material are well known in the art. Basically, such methods comprise stretching the sheet or film at least in the machine or longitudinal direction, by an amount of about 1.5–7 times its original dimension. Such sheet or film may also be stretched in the transverse or cross-machine direction by apparatus and methods well known in the art, in amounts of generally 1.5–7 times the original dimension. Stretching to these ratios is necessary to sufficiently orient the polymer layers and achieve desired levels of thickness uniformity and mechanical properties. Such apparatus and methods are well known in the art and are described, for example, in U.S. Pat. No. 3,903,234. The stretched film is commonly subjected to a heat-setting step after the transverse direction stretch to improve dimensional stability and mechanical properties. Lamination of the polymeric sheet, comprising the antistatic layer onto a reflective photographic support, can be accomplished by any suitable means known in the art.

The polymeric sheet comprising the antistatic layer(s) of the present invention can be incorporated in any reflection photographic imaging support, for example, those comprising paper or synthetic paper, resin-coated or otherwise. The surface upon which the polymeric sheet is adhered may be treated by any of the known methods of the art, e.g., acid etching, flame treatment, corona discharge treatment, glow discharge treatment, etc. for improved adhesion. It is preferred that the polymeric sheet comprising the antistatic layer(s) of the present invention is formed on the imaging support on the side opposite to the photographic emulsion layers. The imaging support may comprise normal natural pulp paper and/or synthetic paper which is simulated paper made from synthetic resin films. However, natural pulp paper mainly composed of wood pulp such as soft wood pulp, hard wood pulp, and mixed pulp of soft wood and hard wood, is preferred. The natural pulp may contain, in optional combination, various high molecular compounds and additives, such as dry strength increasing agents, sizing agents, wet strength increasing agents, stabilizers, pigments, dyes, fluorescent whiteners, latexes, inorganic electrolytes, pH regulators, etc.

As a co-extruded layer, the thickness of the antistatic layer of the current invention can be as thin as 0.1 $\mu$m, but preferably between 0.1–10 $\mu$m. The total thickness of the polymeric sheet of the present invention can vary from 1–500 $\mu$m, but preferably between 10–250 $\mu$m.

The following examples illustrate the practice of this invention. They are not intended to be exhaustive of all possible variations of the invention. Parts and percentages are by weight unless otherwise indicated.

SAMPLE PREPARATION

The IDPs used in the examples of this invention include the following commercial materials:

| IDP | Supplier | Conducting Polymer |
|---|---|---|
| Pebax 1074 | Elf Atochem | Polyether block-copolyamide |
| Pebax 1657 | Elf Atochem | Polyether block-copolyamide |
| Stat-Rite SR X5023 | B. F. Goodrich | Segmented polyether urethane |
| Pelestat PS 3170 | Sanyo | Polyether esteramide |
| Pelestat PS 3180 | Sanyo | Polyether esteramide |
| Panipol 7B2165 | Panipol, Oy | Polyaniline |

The alloying polymers used with the IDPs in the examples of this invention include polyolefins, such as polyethylene (PE) and polypropylene (PP). The carrier polymers with which the antistatic layers are co-extruded in the examples of this invention include polyolefins, such as PE and PP. The melt flow index of the PE and PP used in these examples is 30.0 g/10 min.

In preparation of the samples, the resins are dried at 65° C. and fed by two plasticating screw extruders into a co-extrusion die manifold to produce a two-layered melt stream which is rapidly quenched on a chill roll after issuing from the die. By regulating the throughputs of the extruders it is possible to adjust the thickness ratio of the layers in the cast sheet. In the examples hereinbelow these cast sheets are referred to as "extruded", wherein the thickness ratio of the conducting antistatic layer to that of the carrier layer is maintained at 1:10. In some instances the cast sheet is stretched in the machine direction by 5× at a temperature of 150° C., and then in the transverse direction in a tenter frame by another 5× at a temperature of 150° C. In the examples hereinbelow, these latter samples are referred to as "extruded and stretched" wherein the final film thickness is maintained at 25 $\mu$m. In some other instances, the co-extruded layers are formed directly on photographic paper base and are referred to as "extruded on paper." The layers within the film are fully integrated and strongly bonded Test Methods For resistivity tests, samples are preconditioned at 50% RH (unless otherwise noted) and at 72° F. for at least 24 hours prior to testing. Surface electrical resistivity (SER) is measured with a Keithly Model 616 digital electrometer using a two point DC probe by a method similar to that described in U.S. Pat. No. 2,801,191. For desirable performance, the antistatic layer should exhibit SER values <13 log ohms/square.

For backmark retention tests on photographic paper, a printed image is applied onto the coated papers using a dot matrix printer. The paper is then subjected to a conventional developer for 30 seconds, washed with warm water for 5 seconds, and rubbed for print retention evaluation. The following ratings are assigned:

1=Outstanding, very little difference between processed and unprocessed appearance 2=Excellent, slight degradation of appearance 3=Acceptable, medium degradation of appearance 4=Unacceptable, serious degradation of appearance 5=Unacceptable, total degradation.

For desirable performance, the backmark retention rating should be <4.

EXAMPLES

The following samples 1–13 are prepared as per the current invention. The specific details about these samples are listed in Table 1A, and the corresponding SER and backmark retention data are listed in Table 1B. It is clear that all these samples prepared as per the current invention have SER values less than 13 log ohms/square at 50% RH and, hence, are desirable for antistatic protection for reflection imaging elements. It is also clear that the SER values of samples prepared as per the current invention are not significantly dependent on relative humidity, since the SER variation between 50% and 5% RH is found to be <+1 log ohms/square. This demonstrates the effectiveness of the present invention at a wide range of RH. When tested for backmark retention, the samples prepared as per the current invention are rated between 1–3. As mentioned earlier, a backmark retention rating <4 is considered desirable for reflection photographic imaging element. Thus, it is demonstrated that the samples prepared as per the present invention provide the characteristics desired of reflection photographic imaging elements.

TABLE 1A

| Sample | IDP | Alloying Polymer | Composition of Antistatic Layer | Carrier Layer | Formation |
|---|---|---|---|---|---|
| 1 | Pebax 1074 | PP | Pebax 1074:PP 50:50 | PP | Extruded |
| 2 | Pebax 1074 | PP | Pebax 1074:PP 20:80 | PP | Extruded |
| 3 | Pebax 1074 | PE | Pebax 1074:PE 50:50 | PP | Extruded |
| 4 | Pebax 1657 | PP | Pebax 1657:PP 50:50 | PP | Extruded |
| 5 | Pebax 1657 | PE | Pebax 1657:PE 50:50 | PP | Extruded |
| 6 | Pebax 1657 | PE | Pebax 1657:PE 50:50 | PP | Extruded & stretched |
| 7 | SR X5023 | None | 100% SR X5023 | PP | Extruded |
| 8 | PS 3170 | None | 100% PS 3170 | PP | Extruded |
| 9 | PS 3170 | None | 100% PS 3170 | PP | Extruded & stretched |
| 10 | PS 3170 | None | 100% PS 3170 | PE | Extruded on paper |
| 11 | PS 3180 | None | 100% PS 3180 | PE | Extruded on paper |
| 12 | Panipol 7B2165 | PP | 7B2165:PP 50:50 | PP | Extruded & stretched |
| 13 | Panipol 7B2165 | PP | 7B2165:PP 20:80 | PE | Extruded |

TABLE 1B

| Sample | SER 50% RH log ohms/square | SER 5% RH log ohms/square | Backmark-retention |
|---|---|---|---|
| 1 | 10.7 | 11.2 | |
| 2 | 11.9 | | |
| 3 | 10.5 | 11.2 | |
| 4 | 9.7 | 10.4 | |
| 5 | 9.9 | 10.6 | |
| 6 | 12.8 | | 1 |
| 7 | 11.4 | | |
| 8 | 9.34 | | |

TABLE 1B-continued

| Sample | SER 50% RH log ohms/square | SER 5% RH log ohms/square | Backmark-retention |
|---|---|---|---|
| 9 | 10.9 | | 1 |
| 10 | 9.7 | | 2 |
| 11 | 10.6 | | 3 |
| 12 | 9.4 | | 2 |
| 13 | 10.4 | | |

The invention has been described in detail with particular reference to be certain preferred embodiments thereof, but it will be understood that variations and modifications can be effected within the spirit and scope of the invention.

What is claimed is:

1. A reflection photographic imaging material comprising at least one silver halide layer, a support comprising at least one extruded layer formed integrally with the support comprising a polymeric antistatic material.

2. The imaging material of claim 1 wherein said at least one extruded layer further comprises an alloying material for said polymeric antistatic material.

3. The imaging material of claim 1 wherein said polymeric antistatic material comprises at least one material selected from the group consisting of polyetheresteramide, polyether block copolyamide, and segmented polyether urethane.

4. The imaging material of claim 1 wherein said polymeric antistatic material is on the bottom side of the said support opposite to the said silver halide layer.

5. The imaging material of claim 1 wherein said support comprises a paper sheet.

6. The imaging material of claim 1 wherein said support comprises a biaxially oriented polymer sheet laminated to the bottom of the said support, wherein said biaxially oriented polymer sheet comprises at least one extruded layer of antistatic material.

7. The imaging material of claim 1 wherein said imaging material has a surface electrical resistivity on the bottom side that is less than 13 log ohm/sq.

8. The imaging material of claim 2 further comprising a compatibilizer to aid in dispersion of said polymeric antistatic material in said alloying material.

9. The imaging material of claim 8 wherein said compatibilizer comprises a polyolefin.

10. The imaging material of claim 2 wherein said alloying material comprises polyolefin polymer or a polyester polymer.

11. The imaging material of claim 1 wherein said polymeric antistatic material comprises polyaniline.

12. The imaging material of claim 8 wherein said compatibilizer comprises a polyacrylate.

13. The imaging material of claim 1 wherein said support comprises a synthetic paper sheet.

* * * * *